US007584875B2

(12) United States Patent
Lowe et al.

(10) Patent No.: US 7,584,875 B2
(45) Date of Patent: Sep. 8, 2009

(54) GUN HOLSTER

(75) Inventors: Michael V. Lowe, Boise, ID (US); Anthony J. Senn, Boise, ID (US); Eric Yates, Norfolk, VA (US)

(73) Assignee: Tactical Design Labs, Inc., Boise, ID (US)

( * ) Notice: Subject to any disclaimer, the term of this patent is extended or adjusted under 35 U.S.C. 154(b) by 681 days.

(21) Appl. No.: 10/877,780

(22) Filed: Jun. 25, 2004
(Under 37 CFR 1.47)

(65) Prior Publication Data

US 2005/0040195 A1 Feb. 24, 2005

Related U.S. Application Data

(60) Provisional application No. 60/482,824, filed on Jun. 25, 2003.

(51) Int. Cl.
*F41C 33/02* (2006.01)

(52) U.S. Cl. ..... 224/243; 224/193; 224/912

(58) Field of Classification Search ..... 224/192, 224/193, 196, 243, 244, 911, 912
See application file for complete search history.

(56) References Cited

U.S. PATENT DOCUMENTS

| | | | | | |
|---|---|---|---|---|---|
| 468,556 | A | | 2/1892 | Anderson | |
| 1,166,781 | A | | 1/1916 | Parrish | |
| 1,430,081 | A | | 9/1922 | Holler | |
| 1,557,339 | A | * | 10/1925 | Sander | 224/542 |
| 1,641,439 | A | | 9/1927 | Jovino | |
| 1,750,139 | A | | 3/1930 | Swift | |
| 1,842,936 | A | | 1/1932 | Franz | |
| 2,551,913 | A | | 5/1951 | Toby | |
| 2,708,537 | A | * | 5/1955 | Dec | 224/196 |
| 2,765,107 | A | | 10/1956 | Browning | |
| 3,630,420 | A | | 12/1971 | Bianchi | |
| 3,642,184 | A | | 2/1972 | Hendricks | |
| 3,688,953 | A | * | 9/1972 | Bianchi et al. | 224/192 |
| 3,718,240 | A | * | 2/1973 | Rose | 224/243 |
| 3,847,315 | A | * | 11/1974 | Bianchi | 224/616 |
| 3,865,289 | A | | 2/1975 | Boren | |
| 3,910,469 | A | | 10/1975 | Baldocchi | |
| 4,024,997 | A | * | 5/1977 | Kolpin | 224/584 |
| 4,101,060 | A | | 7/1978 | Bianchi et al. | |
| 4,256,243 | A | | 3/1981 | Bianchi et al. | |
| 4,277,007 | A | | 7/1981 | Bianchi et al. | |
| 4,318,503 | A | | 3/1982 | Capano | |
| 4,383,371 | A | | 5/1983 | Coffey | |
| 4,591,081 | A | * | 5/1986 | Bianchi et al. | 224/192 |
| 4,846,384 | A | | 7/1989 | Perry | |
| 4,865,238 | A | * | 9/1989 | Bianchi | 224/193 |
| 4,925,075 | A | | 5/1990 | Rogers | |
| 4,934,574 | A | | 6/1990 | Salandre | |
| 5,018,654 | A | | 5/1991 | Rogers et al. | |
| 5,048,735 | A | | 9/1991 | McCormick | |

(Continued)

*Primary Examiner*—Nathan J Newhouse
*Assistant Examiner*—Justin M Larson
(74) *Attorney, Agent, or Firm*—Robert L. Shaver; Dykas, Shaver & Nipper, LLP

(57) ABSTRACT

A security holster for handguns which utilizes a U-shaped rod as part of the locking and releasing mechanism. The user presses a handgun against a portion of the U-shaped rod, which pushed the U-shaped rod forward, and causes the locking tab to seat against the ejection port or another feature of the handgun.

24 Claims, 13 Drawing Sheets

U.S. PATENT DOCUMENTS 5,094,376 A 3/1992 Baruch
5,100,036 A 3/1992 Rogers et al.
5,129,562 A 7/1992 Bianchi
5,150,825 A 9/1992 Nichols
5,215,238 A 6/1993 Baruch
5,234,145 A 8/1993 Padin
5,275,317 A 1/1994 Rogers et al.
5,282,559 A 2/1994 Wisser et al.
5,284,281 A * 2/1994 Nichols ..... 224/244
5,294,031 A 3/1994 Volpei et al.
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,467,909 A 11/1995 Resca et al.
5,495,967 A 3/1996 Parton
5,505,355 A 4/1996 Williams
5,509,591 A 4/1996 Carver
5,518,155 A 5/1996 Gallagher
5,570,830 A 11/1996 Nichols
5,573,157 A 11/1996 Mauriello et al.
5,598,958 A 2/1997 Ryan, III et al.
5,611,164 A 3/1997 Rassias
5,622,295 A 4/1997 Hellweg et al.
5,622,297 A 4/1997 Rogers et al.
5,630,535 A 5/1997 Valenti
5,718,363 A 2/1998 Graves
5,779,114 A 7/1998 Owens
5,810,221 A 9/1998 Beletsky et al.
5,810,222 A 9/1998 Shoemaker
5,828,301 A 10/1998 Sanchez
5,855,305 A 1/1999 Nichols
5,894,976 A 4/1999 Harper
5,916,087 A 6/1999 Owens
5,918,784 A 7/1999 Serpa
5,927,578 A 7/1999 Kay
5,931,358 A 8/1999 Rogers
5,944,239 A 8/1999 Rogers et al.
6,050,465 A 4/2000 Nelson et al.
6,112,962 A 9/2000 Matthews
6,149,042 A 11/2000 Rassias
6,189,751 B1 2/2001 Tserng
6,230,946 B1 5/2001 Vor Keller et al.
6,267,279 B1 7/2001 Matthews
6,276,581 B1 8/2001 Glock
6,283,351 B1 9/2001 Brite
6,320,975 B1 11/2001 Vieweg
6,385,890 B1 5/2002 Amadini
6,467,660 B1 10/2002 Rogers et al.
6,523,374 B1 2/2003 Owens
6,533,149 B2 3/2003 Vor Keller et al.
6,547,111 B2 4/2003 French
6,588,635 B2 7/2003 Vor Keller et al.
2001/0019071 A1 9/2001 Vor Keller et al.
2001/0048009 A1 12/2001 Vor Keller et al.
2002/0011504 A1 1/2002 Cerato
2002/0047029 A1 4/2002 Liao
2002/0070253 A1 6/2002 Beletsky et al.
2002/0134803 A1 9/2002 Lowe et al.

* cited by examiner

GUN HOLSTER

PRIORITY

This application claims priority from a provisional patent application filed on Jun. 25, 2003 with application Ser. No. 60/482,824 entitled "Security Holster".

BACKGROUND OF THE INVENTION

1. Field of the Invention

The present invention generally relates to handgun holsters, and more particularly relates to holsters, which provide security against unauthorized withdrawal of a handgun.

2. Background Information

Police, security officers, and military personnel in a number of situations must be ready to withdraw and use a handgun in the line of duty at a moment's notice. In an emergency situation, withdrawing the handgun must be done in a completely natural and unobstructed manner so that it can be withdrawn as quickly as possible. The officer's life may depend on the speed with which he can withdraw the handgun. However, after the handgun is withdrawn, the situation may dictate other options or needs, requiring the officer to re-holster the handgun just as quickly. Current holsters do not meet this demand, without some continued manipulation of security straps, before the officer knows or has confidence that the weapon is secure. In this type of situation, the officer needs to be able to holster his handgun with one hand without looking at the holster, and while maintaining eye contact with the person in question.

The problem results when a suspect becomes an assailant, and attacks the officer and tries to gain access to his weapon. In the event of an attack, a holster is likely to be bumped, jostled, pried, and pressured with forces exerted on nearly any part of the holster. Some holsters have release mechanisms that may be accidentally engaged during such an assault, releasing the weapon from the effective grip of the holster. When an assailant attacks, it is of utmost importance that the officer maintains control of his handgun, and that the assailant does not get access to the handgun. Many holsters have been designed to accomplish this purpose in a number of different manners. However, they all suffer a number of drawbacks. Some require two hands to release and secure the handgun. This is unacceptable. Some of them secure the handgun with a device that can be difficult to release in a fast draw situation, and therefore is a dangerous security mechanism. Some holsters secure the weapon in place to keep it from bouncing out of the holster, but are not designed to withstand the attack of an assailant and would allow the handgun to be taken from the officer by the assailant. Some holsters use electronic devices for fingerprint recognition and run the risk of malfunctioning or having a dead battery. Some holsters require the user to tilt or rock the handgun, or twist it before it can be released from the handgun. Such a maneuver must be practiced frequently in order to ensure that the wearer can perform it without mistake in an emergency situation. Many of the holsters are unable to address the above-mentioned problems or provide a security holster for a left-handed user. Additionally, many holster using groups desire to have a uniform pattern for their equipment. Some groups use specific patterns and symbols to identify a user's equipment and identity. Most security holsters provide no manner in which the holsters can be customized or individualized for an individual or specific group. All of the above named difficulties are problems that face a security holster user, and an improved security holster is needed which solves these problems.

For these reasons, it is an object of the present invention to provide a security holster for use by left-handed and right-handed users, which allows a handgun to be quickly inserted or withdrawn with one hand without looking at the holster, and which secures the holster to the officer without undue manipulation of the handgun. It is a further goal of the invention that the security holster and corresponding locking and releasing mechanisms prevent an unauthorized withdrawal of the handgun due to an accident or during an assault on the wearer. It is a further object of the invention to provide a handgun-securing holster that is easily released by a natural and fluid motion of the officer whether left or right-handed. It is a further object of the invention to provide a security holster that may be fluidly inserted or removed from the holster. Another object of the invention is to provide a security holster that may be effectively customized with adhesive inlays for standardization and matching purposes. Another object of the invention is to require a minimum compression force that must be exerted on the security holster in order to engage and disengage the locking mechanism for a handgun.

SUMMARY OF THE INVENTION

One embodiment of the holster is specifically for left-handed users of a semi-automatic handgun. It includes a holster body. The holster body includes inner and outer rigid sidewalls that are spaced apart to define an inner cavity. The inner cavity has an open top portion into which the handgun is inserted. The top portion is also identified as the rear of the holster. The portion of the holster that is adjacent to the end of the handgun barrel is designated as the front or bottom of the holster. The holster also includes a locking means, which is designed to allow the handgun to pass by it. When the handgun is seated in the holster, the locking means is designed to engage a feature of the handgun, thereby preventing the withdrawal of the handgun prior to the release of the locking means. The security holster also includes a releasing means, which is mounted so that when a handgun is inserted within the holster, the releasing means is adjacent the right side of the handle of the handgun. In this version of the holster, the releasing means is configured for activation by movement of a user's left thumb. The releasing means is a release tab that is depressed by a left-handed user's left thumb as he/she reaches for the handgun. When the user's hand is on the handle of the handgun, the release tab is positioned directly below his/her thumb over the right side of the handgun handle. The release tab is operationally connected to a locking tab, and when the release tab is pressed down, the locking tab disengages from the handgun feature and allows the handgun to be withdrawn.

This version of the holster provides for one-handed insertion of the handgun into the security holster. When a handgun is pressed into the holster, the locking tab engages a handgun feature such as a trigger guard, the slide, or preferably an ejection port. This engagement prevents the handgun from being withdrawn until the release tab is activated by the left-handed user's left thumb.

The locking tab is a generally planar projection that extends from an arm connected to the release tab. The locking tab is configured to move from an open position that allows entry of the handgun without the handgun touching the locking tab, into a closed position in which the locking tab engages a feature of the handgun. The locking tab can be activated to move into engagement with the handgun feature such as the ejection port by compression of one or more springs built into the holster. Preferably, the locking tab passes through the ejection port on the slide of the semi-automatic handgun and locks under the ejection port on the slide, adjacent the barrel of the handgun. Alternatively, any feature of the slide could also be utilized because not all models of handguns have a space under the ejection port that can be utilized. Once engaged, the locking tab is typically pressed into engagement with the handgun feature by a spring, which is compressed during insertion into the holster.

The release tab of the holster is typically an elongated tray, which is configured for sliding engagement with the left-handed user's left thumb. The elongated tray extends from over the trigger guard to partially over the handle of the handgun, which allows the left-handed user to activate the release tab with his/her left thumb.

Another feature of this configuration of the device is that the locking tab engages the handgun feature with an audible indication of locking. This is typically a distinctive click, which in most environments can easily be heard and is a certain indication to the user that the handgun is engaged in the holster. The locking tab engages with sufficient force so that there is also a tactile indication of locking, which the user may feel through the handle of the handgun or through the body of the holster into his/her hip region. This version of the holster typically includes a pressure switch, which activates the locking means when the handgun is pressed into the holster with a required degree of insertion force. The pressure switch, also called a rebounding device, also operates with the releasing means, and a minimum degree of insertion force is required before the handgun is released.

Other embodiments of the security holster can include left or right-handed versions. A feature of one embodiment of the security holster is that the locking mechanism does not contact the slide of the gun as the gun is inserted into the holster. This is accomplished because the locking tab rests against the outside of the security holster until the locking tab is moved laterally, at which time a torsion spring causes the locking tab to rotate down and engage a feature of the handgun, such as an area between the slide ejection port and the barrel of the handgun. Lateral movement of the locking tab is caused by downward pressure from the handgun. Similarly, to release the handgun, downward pressure of the handgun is required so that the locking tab again moves laterally and clears the ejection port of the holster and may be raised away from the handgun by pressing the release tab.

A distinctive feature of the holster is that one action is utilized to seat the handgun and secure it in the holster. This action is pressing the handgun down. Seating it in the locking mechanism of the holster is clearly indicated by an audible click of the locking tab, and can also be felt through the user's hand or holster. Three actions are required to remove the handgun from the holster. These three actions are: (1) pushing the gun down, (2) depressing the release tab, and (3) lifting the handgun out of the holster while depressing the release tab for a certain portion of the withdrawal.

Another feature of one embodiment of the present invention is that the locking mechanism includes a generally U-shaped rod. The rod has a right side, a left side, and a joining piece, which together forms a U-shape. The joining piece passes through a pair of slots or notches in the inner and outer side of the holster, and the left and right side of the U-shaped rod are attached to the holster, but are configured to move laterally in relation to the holster, parallel with the long axis of the holster. Typically, they are attached to the holster by bosses or guides on the left and right hand side. Preferably, one spring is utilized on both sides of the U-shaped rod, which urge the U-shaped rod toward the rear of the holster.

When a handgun is inserted into the holster, the front of the handgun contacts the joining piece of the U-shaped rod. Continued pressure on the handgun pushes the U-shaped rod forward, and the joining piece moves in two slots on the front of the handgun. When the handgun is pressed down, the two springs on either side of the U-shaped rod are compressed, and when the handgun is released, these springs press the handgun toward the rear or open end of the holster.

Also attached to the U-shaped rod is a locking tab. The locking tab is preferably urged to rotate toward the barrel of the gun by attachment to one of the springs, which is around the right side of the U-shaped rod. In the open position, the release tab is pressed into the side of the holster by the first spring. When the U-shaped rod is pressed toward the front of the holster, the locking tab moves with it, and at a certain point clears the ejection port slot of the holster body, and is caused by the spring to pass through the ejection port slot of the holster, which at that time is also lined up with the ejection port of the handgun. This allows the locking tab to pass through the ejection port of the slide and to contact the barrel of the handgun. After contacting the barrel of the handgun, when the handgun is released, the springs push the U-shaped rod and the locking tab toward the rear of the holster, and the side of the locking tab presses against the side of the ejection port slot of the holster body. Different handguns have different configurations, and in other handguns another feature of the handgun, preferably a feature on the slide, would be engaged. Once the handgun is released, it is locked in place until the releasing means is activated.

The user activates the releasing means by pressing down on the handgun. This causes the U-shaped rod to move toward the front of the holster and also moves the locking tab laterally. When the locking tab is moved sufficiently toward the front of the holster, it becomes clear of the ejection port of the handgun and may be lifted away from the handgun by the user's thumb or finger pressing down on the release tab. When this happens, the handgun may be removed from the holster. While the handgun is being removed from the holster, the release tab may be pressed down for a portion of the withdrawal by the thumb and/or finger as it slides over the release tab toward the rear of the holster.

A significant feature of the holster is that one spring is utilized to accomplish two actions. The first action is to urge the U-shaped rod toward the rear of the holster, and thus urge the handgun out of the holster. The second action is that the same spring applies a rotating or torsional force to the locking tab and pushes it toward the handgun.

Another feature of the security holster of the present invention is that the surface of the holster has one or more inlay receiving regions. Each inlay-receiving region is basically a recess in the holster's surface, surrounded by a raised edge. Into each of these recesses, an adhesive backed inlay may be placed. These inlays are the same depth as the recess so that the inlay does not extend above the surface of the holster. Due to the inlay receiving regions, the inner wall of the recess surrounds each edge of each inlay, and no inlay edge is exposed to wear. The result of this is that the recesses protect the inlays from wear, and the inlays do not tend to peel up at the edges. The purpose of the inlays is to allow the holster to receive a decorative surface to match the requirements of any particular gun user. For instance, one particular police department may require a certain style or finish on the accessories that the officers carry. In this way, a plastic holster can be covered with a decorative surface pattern, such as basket weave, to match the other accessories being carried by a police office. The inlays can also contain the insignia of an organization or artwork preferred by any particular user. The inlays can also be of a color chosen by the user and may contain reflective material to make the holster more visible at night.

A feature of all embodiments is an optional detachable overlay, which can be snapped into place on the holster of the invention. The overlay forms a protective shield around the release tab, and thus is a finger tube into which a user must place a portion of his/her finger in order to access the release tab. In some embodiments the finger tube is not removable and formed in the region between the handgun and the holster body. This feature restricts access to the release tab, and makes release of the handgun difficult for anyone other than the wearer of the holster.

One embodiment of the invention includes a release tab on the left side of the handgun. In this version, a locking means is configured to admit the handgun into the security holster. It is also adapted to engage a handgun feature of the handgun placed in the inner cavity of the security holster, thereby preventing the withdrawal of the handgun prior to release of said locking means.

This embodiment includes a releasing means located adjacent to said left side handle of the handgun for releasing the locking means by movement of a user's right thumb or left hand index finger. The releasing means is a release tab that is configured for engagement with the user's right thumb when a right-handed user reaches for, releases, and removes the handgun from the holster. The release tab is operationally connected to a locking tab. The release tab is activated by pressure of a user's right thumb or left hand index finger, which disengages the locking tab from said handgun feature when said release tab is depressed.

This embodiment of the security holster includes a release ramp that lifts the locking tab out of the ejection port when the locking tab moves forward. The release is connected to the locking tab by a rod that passes from the left side of the handgun to the right side of the handgun. The rod has one or more springs attached to it, which urges the linking rod toward the rear of the holster and urges the locking tab into engagement with the ejection port.

Still other objects and advantages of the present invention will become readily apparent to those skilled in this art from the following detailed description wherein we have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
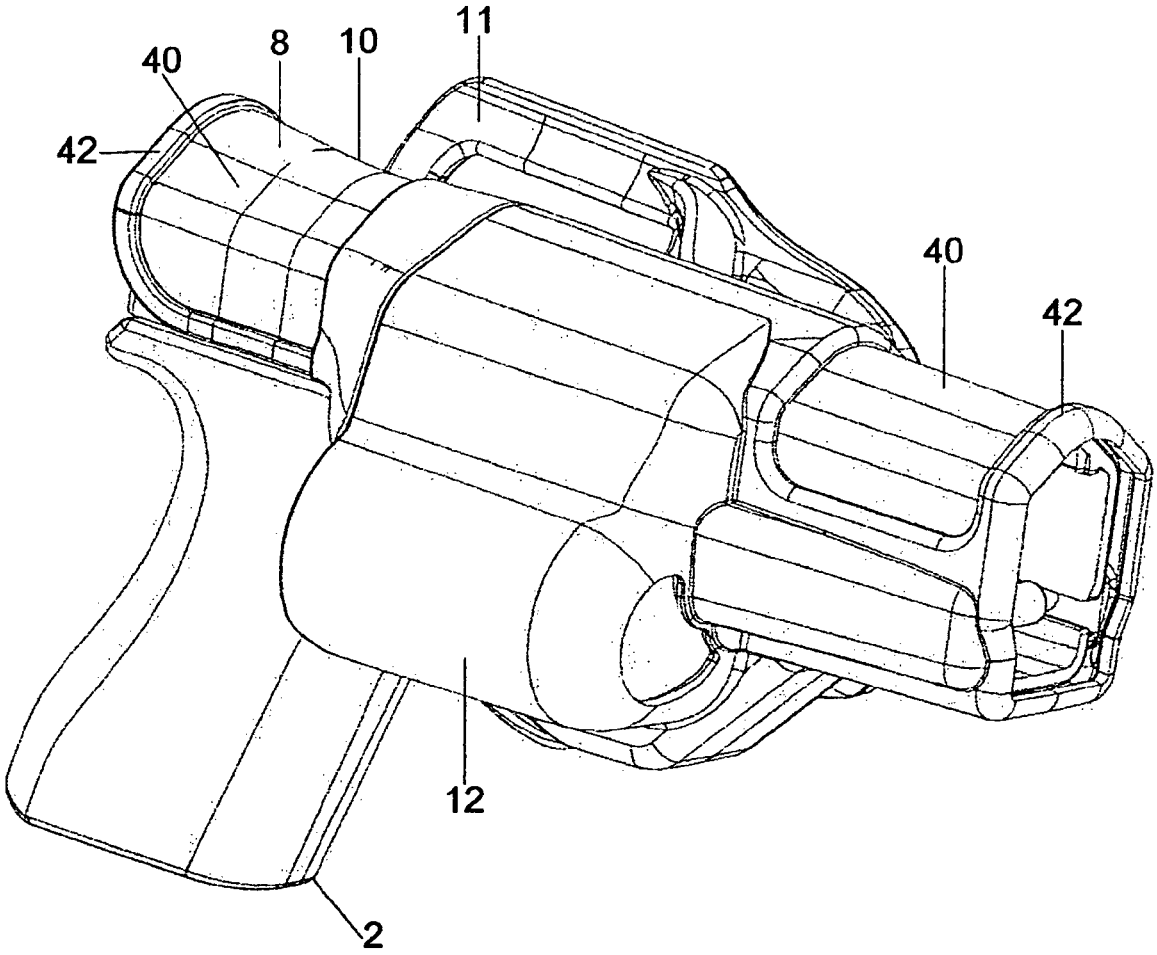
FIG. 1 is a perspective view of a preferred embodiment of the right-handed security holster.

While the invention is susceptible to various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a security holster for use with a handgun that allows rapid insertion of the handgun and equally rapid withdrawal of the handgun. The security holster also provides a secure locking mechanism that secures the handgun in the holster until the user releases it.

Several preferred embodiments and features of the security holster are shown in FIGS. 1-14. The security holster shown in FIG. 1 shows a perspective view of the general configuration of the security holster when used with a handgun 2, and is designated as 10 in the figures. Preferably, the security holster is made of a tough and durable plastic such as Kydex (Mfg. By Kleerdex Company). A thickness of ⅛ inch of this material has been found to be suitable for making the security holster. Other materials or thicknesses of materials that have similar characteristics of rigidity, strength, and weight would also be suitable. This might include metal such as aluminum, steel, other types of plastics, or leather. The security holster 10 is not limited strictly to handguns. In additional embodiments, the security holster 10 may be adapted to holster additional devices such as stun guns, tools, or other instruments that could benefit from the features of the present invention.

The security holster 10 includes a holster body and an attachable overlay 12. The attachable overlay 12 wraps either fully or partially around the holster body, and covers the locking and release mechanism. A belt mount 11 is also shown for mounting the security holster 10 to a user's belt.

Figure 2:
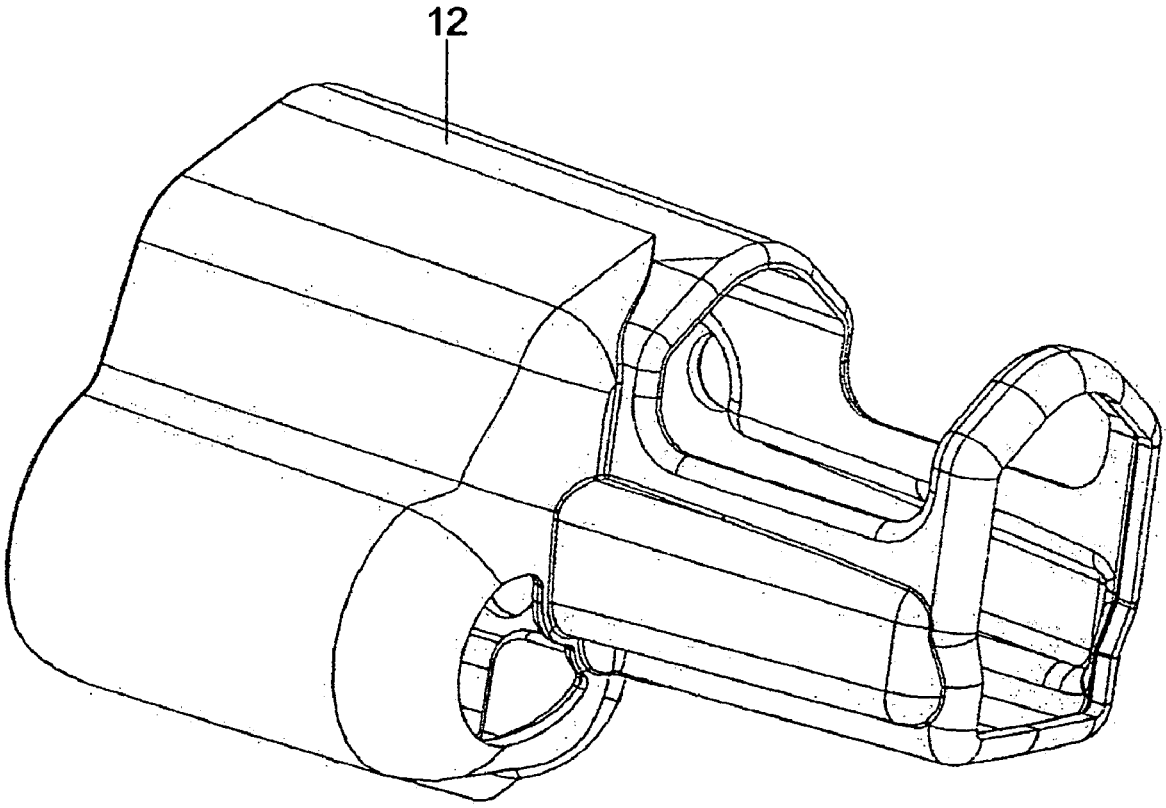
FIG. 2 is a perspective view of the attachable overlay.

FIG. 2 shows the attachable overlay by itself. The attachable overlay 12 allows a security holster 10 user to adapt the holster to expected conditions. If a user expects dangerous conditions, the attachable overlay 12 may be connected to the security holster 10. In a preferred embodiment of the present invention, the attachable overlay is a molded part designed to snap onto the exterior of the security holster 10. In additional embodiments, the attachable overlay 12 may include snaps, straps, or other mechanisms for securing the overlay to the security holster 10. The attachable overlay 12 could easily be attached if a user felt the added protection necessary, and removed later as desired by the user. The attachable overlay 12 provides a protective shield or finger tube around the release mechanism of the security holster. In some embodiments the finger tube is not removable and formed in the region between the handgun and the holster body. The finger tube protects the release tab from activation by an assailant or from accidental activation by the wearer brushing against a building or rolling on the ground.

Figure 3:
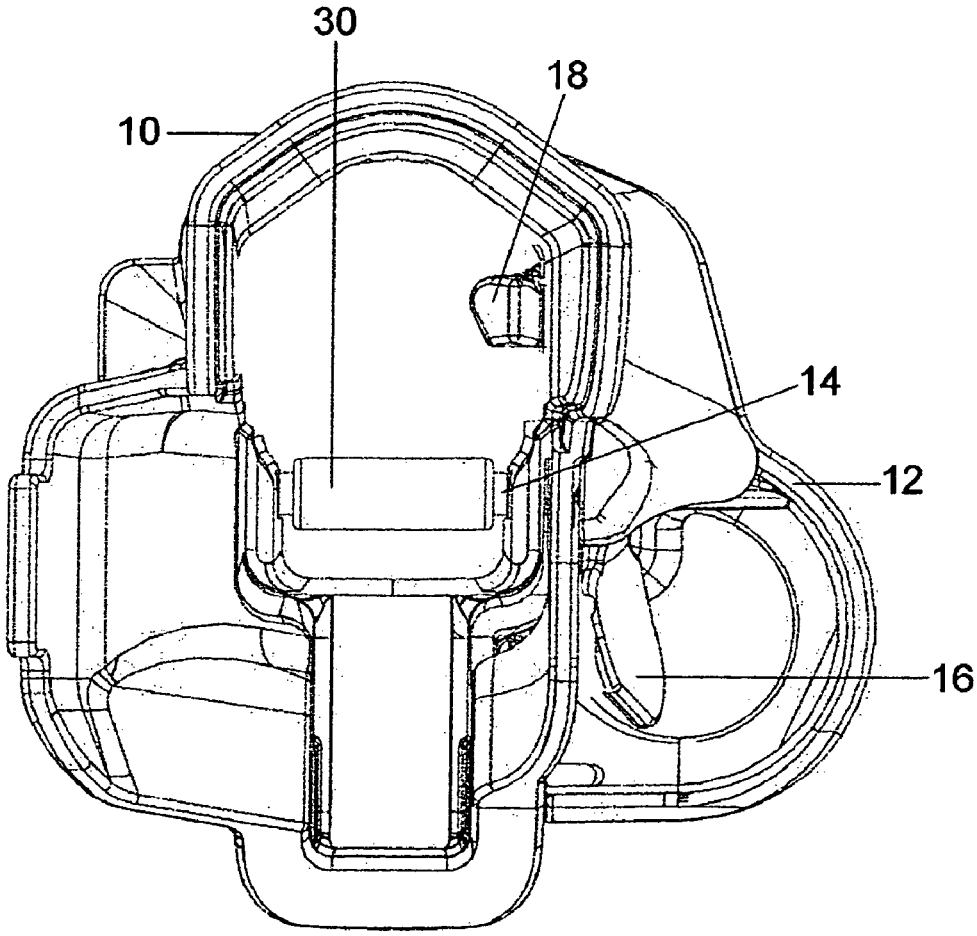
FIG. 3 is a rear view of an empty right-handed security holster.

FIG. 3 is a rear view of the security holster without a handgun inserted. The attachable overlay 12 attaches to the holster body to form a finger tube or finger flare which is an opening or finger-receiving receptacle between the attachable overlay 12 and the holster body, which allows insertion of a user's index finger and serves to help the user position his/her finger on the release mechanism. By covering the locking and release mechanisms, the handgun 2 cannot easily be accidentally released when a user is lying on the holster, when it is bumped or rubbed against something, or is under attack by an assailant.

Figure 10:
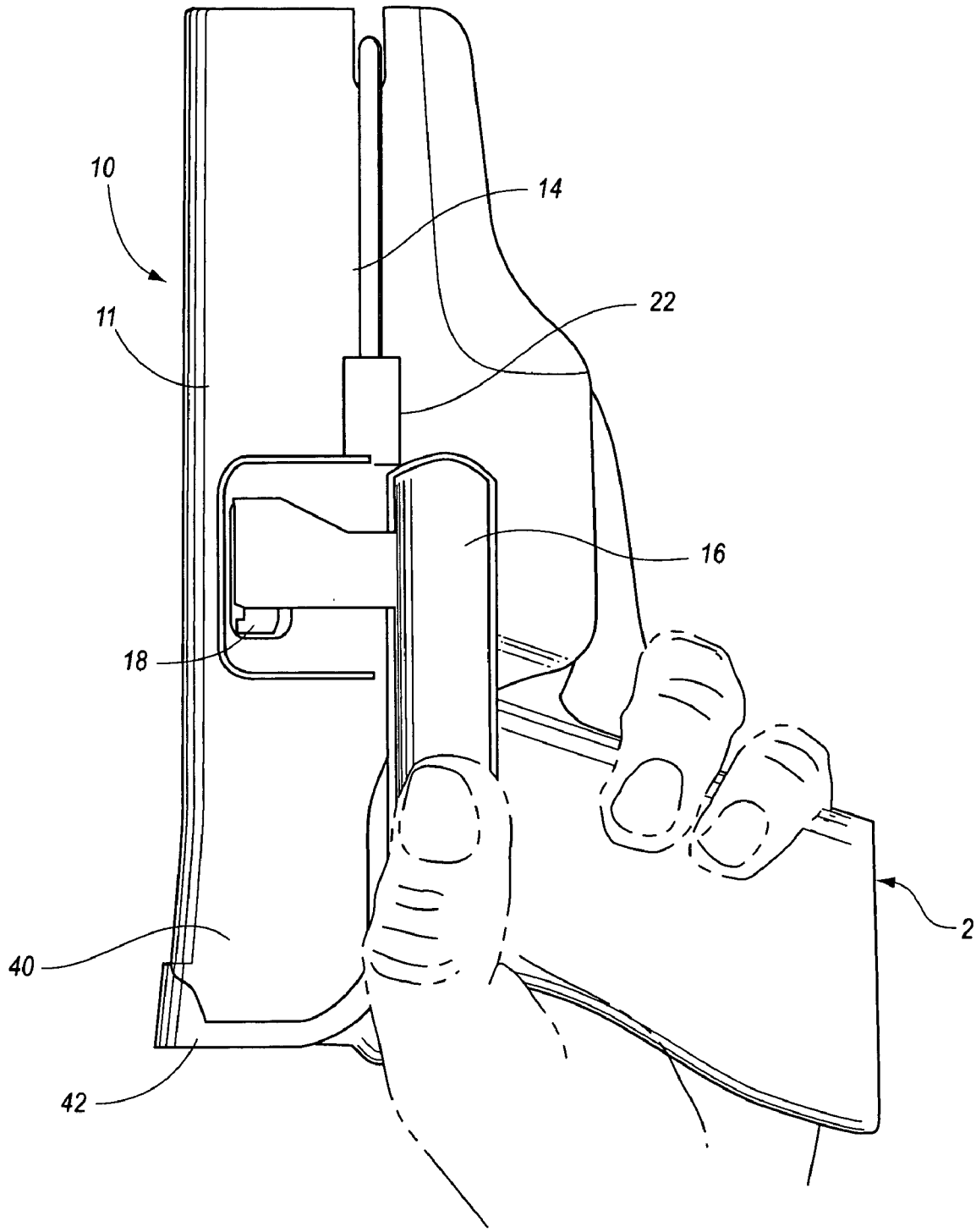
FIG. 10 is a perspective view of a left-handed security holster.

The release tab mechanism of the security holster 10 may be engaged when a user flexes a finger in the direction of the release mechanism. In a left-handed security holster 10, the release may be engaged by a users thumb, as shown in FIG. 10. As used herein, any digit, finger, thumb, or other appendage inserted into the security holster for the purpose of releasing a handgun will generally be referred to as a finger, except in the specific use of a users thumb in a left-handed holster. In the preferred embodiment, release is accomplished by flexing the finger in a direction normal to the plane of the security holster and corresponding handgun against a release tab. Flexing is defined as the bending of a portion of a finger about a joint that allows the finger to apply pressure against a surface or mechanism. A release tab is positioned so that it can be released by a finger flexed in a single direction, which provides an additional safety feature. The tendons of a finger only allow a finger to be flexed in a direction toward the palm of the hand. As a result, an unauthorized person that is able to insert a finger in between the attachable overlay 12 and the holster body, would not be able to release the handgun by finger flexure.

Figure 4:
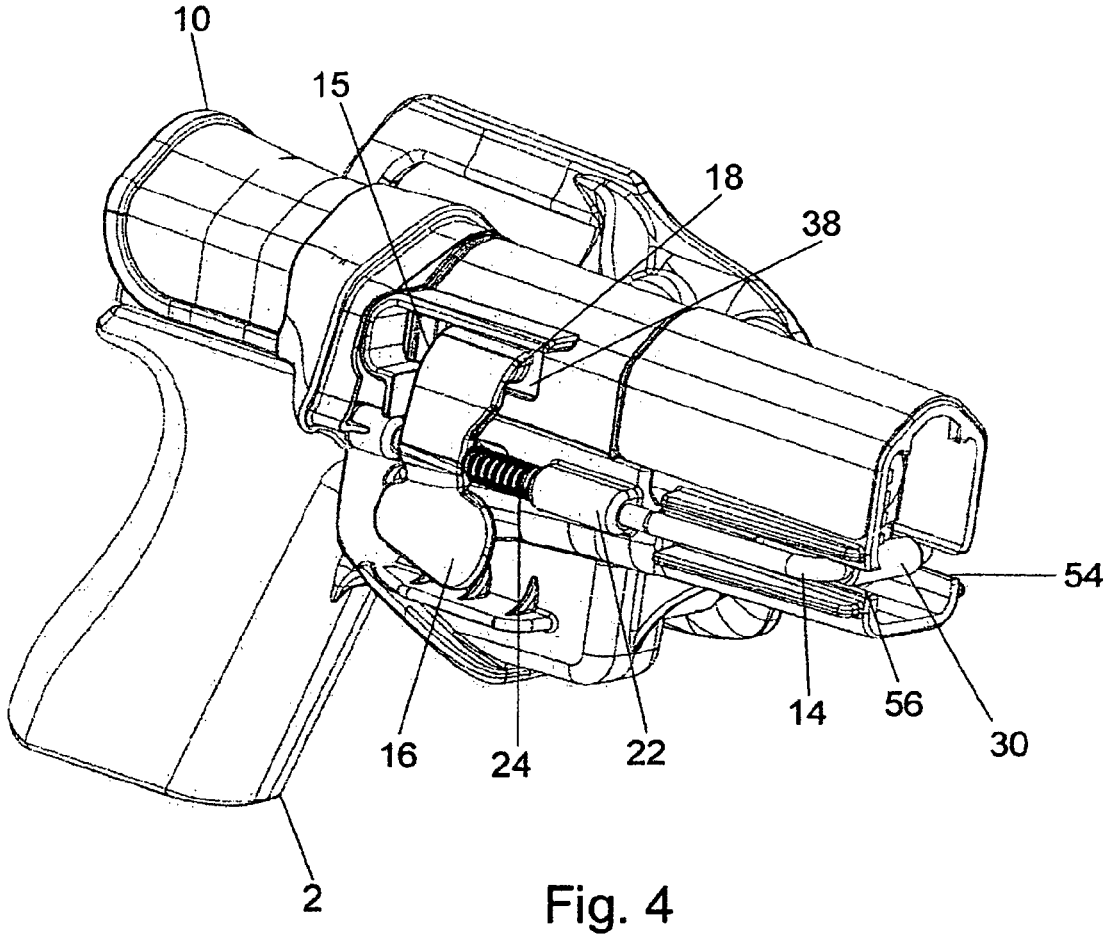
FIG. 4 is an outer perspective view of the right-handed security holster loaded with a handgun with the attachable overlay removed to reveal the release and locking mechanism of this embodiment.

FIG. 4 shows a perspective view of the right-handed security holster of the invention, loaded with a handgun with the attachable overlay removed to reveal the release and locking mechanism. In the preferred embodiment, the release tab 16 and the locking tab 18 are formed from a single piece of hardened plastic to form a lever 15. The lever 15 of the present invention is a first class lever because the fulcrum is between the load and the effort force. In the present invention, the hinge connection (the fulcrum point rotating about a U bar 14) is a tube 46 and is between the locking tab 18 (the load) and the release tab 16 (effort force).

The lever 15 includes a release tab 16, which is semicircular in cross section and fitted to receive the index finger of a user, and lies over the trigger and trigger guard of a handgun 2 when it is fully inserted into the security holster 10. The release tab 16 is angled so that as a user inserts a finger between the attachable overlay 12 and the holster body, the finger slides up and onto the release tab for easy access.

Figure 5:
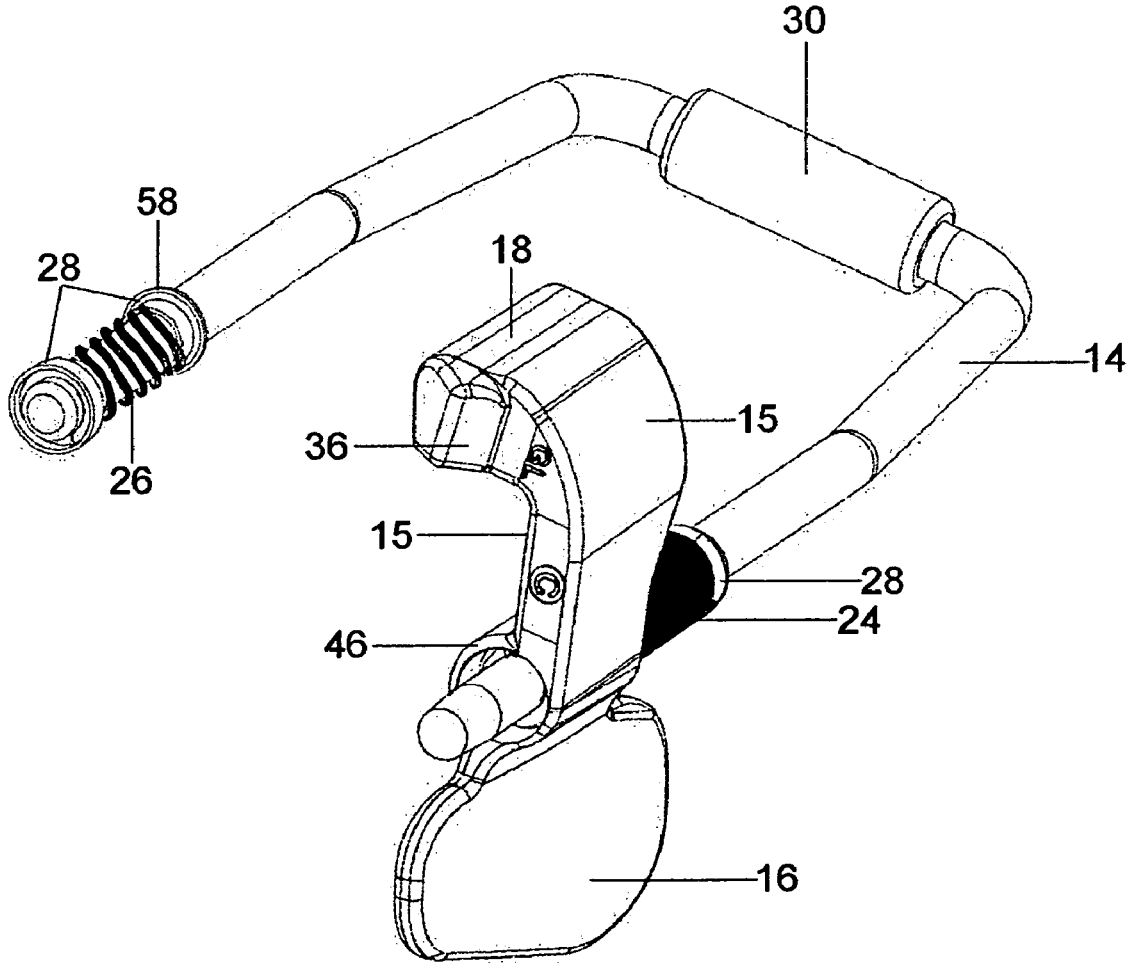
FIG. 5 is a perspective view of the U-shaped rod locking mechanism of a right-handed security holster.

FIG. 5 is a perspective view of the locking mechanism of the right-handed security holster. The locking tab 18 preferably has a pointed or ramped end 36 that facilitates locking and releasing the handgun. In the preferred embodiment, the locking tab 18 passes through an ejection port slot 38 defined in the holster body, in order to engage the ejection port of the handgun. The lever 15 preferably defines an inner cavity, or tube 46, that is designed to function as a hinge or pivot point. The lever 15 pivots on a U bar or rod 14 with a right portion of the U bar 14 passing through the tube 46 defined by the lever 15. The lever 15 is preferably biased by a torsion spring 24. The torsion spring 24 biases the lever 15 so that the locking tab 18 is always pressing toward the holster body and handgun 2. The same torsion spring 24 also biases the release tab 16, pressuring it away from the holster body toward the attachable overlay when connected.

Figure 6:
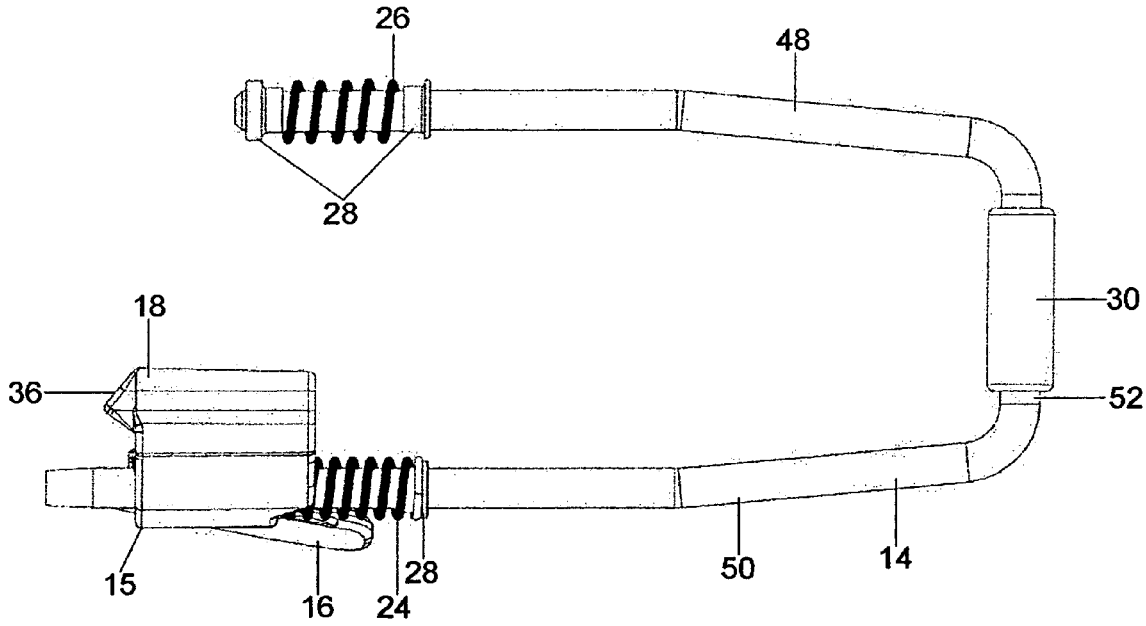
FIG. 6 is a top view of the U-shaped locking mechanism of a right-handed security holster.

Another unique feature of one embodiment of the present invention is the previously mentioned U bar 14. FIG. 6 is a top view of the locking mechanism of the present invention. The U bar 14 has a right side 48, a left side 50, and a joining piece 52, which together form a U-shape. The joining piece 52 passes through a pair of notches (left notch 54 and right notch 56) or aperture guides in the inner and outer side of the security holster 10 defined by the holster body, and the left and right side of the U bar 14 slidably passing through the notches 54 and 56 of the security holster and are configured to move laterally with relation to the holster, parallel with the long axis of the holster.

In one embodiment, the torsion spring 24 and compression spring 26 are held in place when positioned on the U bar 14. The U bar 14 may have a pair of circular grooves near the ends of the sides 48 and 50 of the U bar. A snap ring 58 is fitted over each of the grooves in the U bar 14. The compression spring 26 and the torsion spring 24 may be held in place by bushings 28 that are compressed out until they encompass and are fixed from moving by the snap rings. On the right side of the U bar 14 it is preferred that the torsion spring 24 is secured in the rear by a bushing abutted against the lever 15. The lever 15 may be supported at the rearmost portion by a snap ring and corresponding bushing. The bushings 28 have various purposes. The ends of the springs rest on the bushings 28 and as a result the bushings 28 prevent the compression spring 26 and torsion spring 24 from making noise as they are compressed and moved, providing a low friction surface. The bushings also hold the springs from contacting the surface of the U bar as they are compressed.

Figure 7:
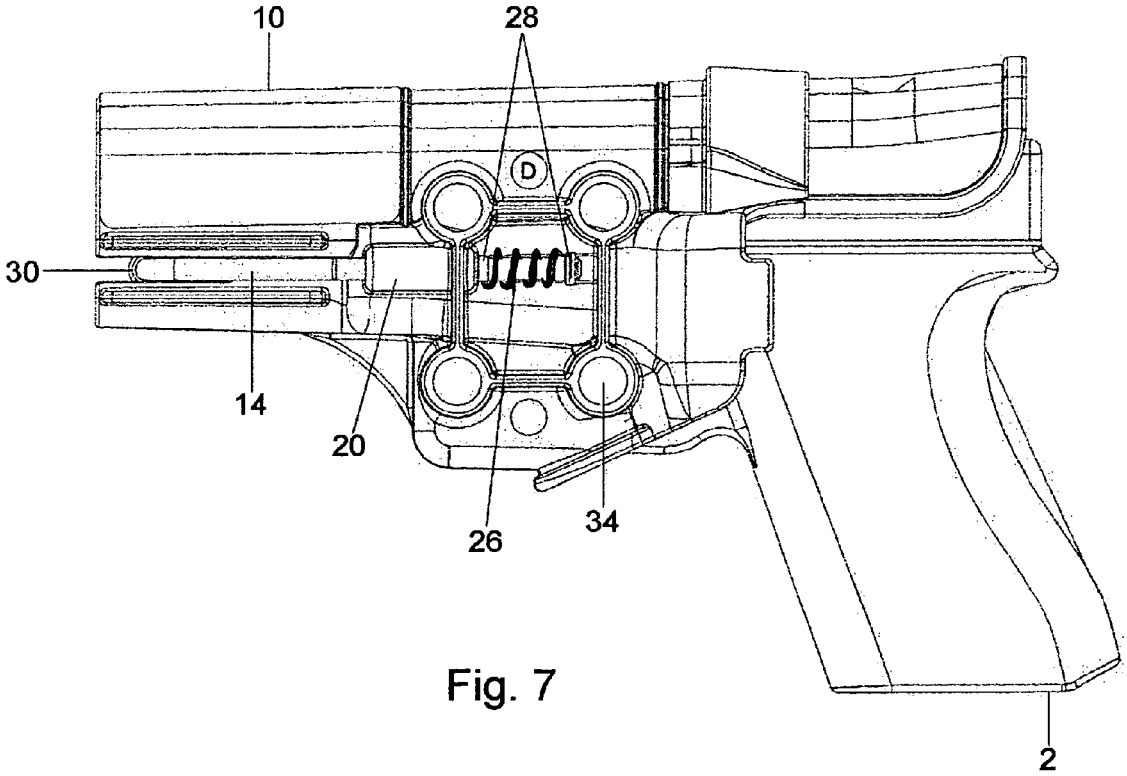
FIG. 7 is a view of the left side of a right-handed security holster loaded with a handgun, with the attachable overlay removed to reveal the release and locking mechanism.

FIG. 7 shows a perspective view of the left side of the security holster loaded with a handgun 2, with the attachable overlay 12 removed to reveal the release and locking mechanism of this embodiment. Guides 20 and 22 are shown, and hold the U-shaped rod 14 against the holster body 8. Typically, the left guide 20 and right guide 22 are molded into the body 8 of the security holster 10. In an additional embodiment, the guides are attached to the holster 10 by bosses on the left and right hand side. Preferably, one spring is utilized on both sides of the U-shaped rod 14, which urge the U-shaped rod 14 toward the rear 60 of the holster. The spring utilized on the inner or left side of the handgun 2 is preferably a compression spring 26 designed to provide the majority of the force exerted toward the front of the holster 10 on the U bar 14. Multiple belt mounting apertures 34 are also shown for attaching the security holster 10 to a belt mount so that a user can effectively wear the holster 10.

Figure 8:
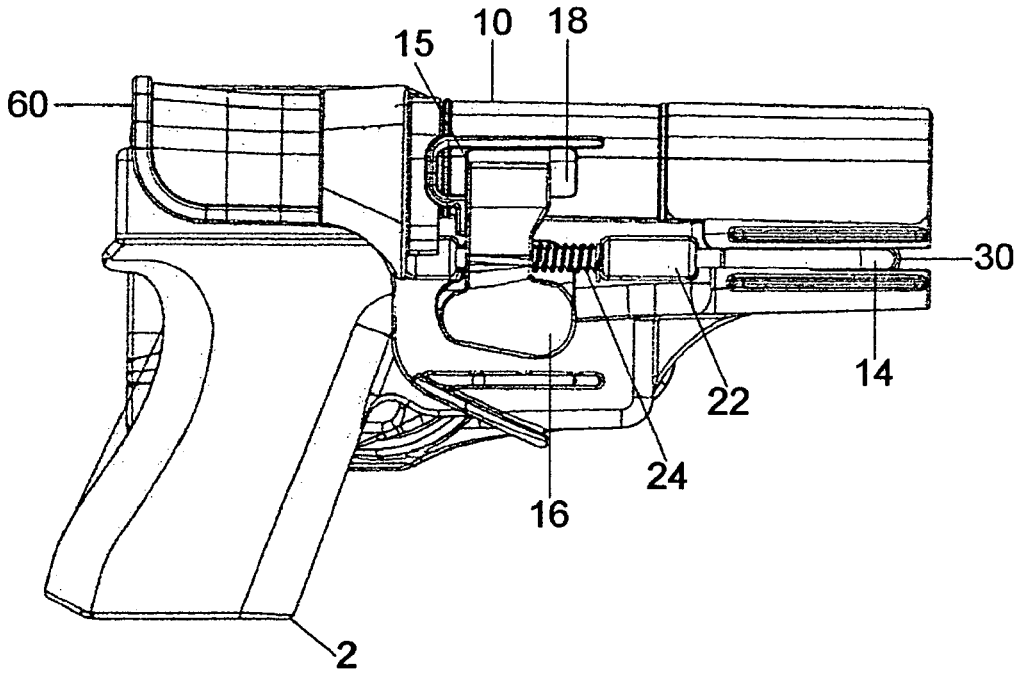
FIG. 8 is an outer side view of the right-handed security holster loaded with a handgun with the attachable overlay removed to expose the release and locking mechanism.

FIG. 8 is a side view of the right side of the security holster loaded with a handgun, with the attachable overlay 12 removed to expose the release and locking mechanism of this embodiment. The right spring 24 or outer spring, is preferably a torsion spring providing both torsion and compression characteristics for the specific reasons previously mentioned. When a handgun 2 is inserted into the holster 10, the front of the handgun 2 contacts the joining piece 52 of the U bar 14. The joining piece 52 of the U bar 14 is preferably equipped with a bumper 30 that prevents the handgun barrel from being marred, scratched or otherwise damaged due to constant contact with the joining piece 52. The bumper 30 may be rubber, cloth or other material that would not cause damage to the handgun 2 during repeated contact. Continued pressure on the handgun 2 pushes the U bar 14 forward against the springs 24 and 26, and the joining piece moves in two notches 54 and 56 defined in the holster body. When the handgun 2 is pressed down, the compression spring 26 and torsion spring 24 on either side of the U bar 14 are compressed, and when the handgun 2 is released, these springs press the handgun 2 toward the rear of the holster 10.

Also pivotally mounted on the U bar 14 are the lever 15 and corresponding locking tab 18 and release tab 16. The locking tab 18 is preferably urged to rotate toward the barrel of the handgun by attachment to the torsion spring 24, which is positioned on the outer or right side of the U bar 14. In the open position, the locking tab 18 is pressed into the side of the holster 10 by the torsion spring 24. When the U bar 14 is pressed toward the front of the holster 10, the locking tab 18 moves with it, and at a certain point clears the ejection port slot 38 of the holster 10, and is caused by the torsion spring 24 to pass through the ejection port slot of the holster 10, which at that time is also lined up with the ejection port of the handgun 2. This allows the locking tab 18 to pass through the ejection port of the slide, and to contact the barrel of the handgun 2. After contacting the barrel of the handgun 2, when the handgun 2 is released, the springs 24 and 26 push the U bar 14 and the locking tab 18 toward the rear of the holster 10, and the ramped end 36 of the locking tab 18 passes behind the holster body 8 until the side 62 of the locking tab 18 is pressed against the side of the ejection port slot 38. Different handguns have different configurations, and in other handguns another feature of the handgun 2, preferably a feature on the slide, would be engaged. Once the handgun is released, it is locked in place until the releasing mechanism is activated.

The releasing mechanism is activated by the user pressing down on the handgun 2 with a minimum compression or insertion force. This causes the U bar 14 to move toward the front of the holster 10 and also moves the locking tab 18 laterally, parallel to the long axis of the security holster 10. When the locking tab 18 is moved sufficiently toward the front of the holster 10, the ramped end 46 comes clear of the ejection port of the handgun 2, and the locking tab 18 may be lifted away from the handgun by the user's finger pressing down on the release tab 16. As soon as the ramped end 36 of the locking tab 18 is past the ejection port slot 38, the release tab need not be held down anymore. When this happens, the handgun 2 may be removed from the holster 10. While the handgun 2 is being removed from the holster 10, the release tab 16 may be pressed down for a portion of the withdrawal by the finger as it slides over the release tab 16 toward the rear of the holster 10.

A significant feature of the holster is that the torsion spring 24 is utilized to accomplish two actions. The first action is to urge the U bar toward the rear of the holster 10, and thus urge the handgun 2 out of the holster 10. The second action is that the torsion spring 24 applies a rotating or torsional force to the locking tab 18 and pushes it toward the handgun while at the same time pushing the release tab 16 away from the handgun 2 as part of the lever 15 connected to the two tabs.

Another unique feature of one embodiment of the security holster 10 is that the locking mechanism does not contact the slide of the handgun as the handgun 2 is inserted into the holster 10. This is a benefit because it means that there is less wear and tear on the handgun 2 and on the security holster 10. This is accomplished because the locking tab 18 rests against the outside of the security holster 10 until the locking tab 18 is moved laterally, at which time the torsion spring 24 causes the locking tab 18 to rotate down through an ejection port slot 36 defined by the holster body 8 to engage the ejection port of the handgun 2. Lateral movement of the locking tab 18 is caused by downward pressure from the handgun 2 on the interconnected U bar 14. Similarly, to release the handgun 2, downward pressure of the handgun 2 is required so that the locking tab 18 again moves laterally and clears the ejection port slot 36 of the holster and may be raised away from the handgun 2 by pressing the release tab 16.

Returning again to FIG. 1, a perspective view of the right-handed security holster. Another feature of the security holster 10 of the present invention is that the holster body or attachable overlay 12 has or defines one or more inlay receiving regions 40. Each inlay-receiving region 40 is basically a recess in the holster's surface that is surrounded on the edges by an inner wall 42. The inlay receiving regions are the same depth as an inlay or deeper so that the inlay does not extend above the inner walls 42.

Figure 9:
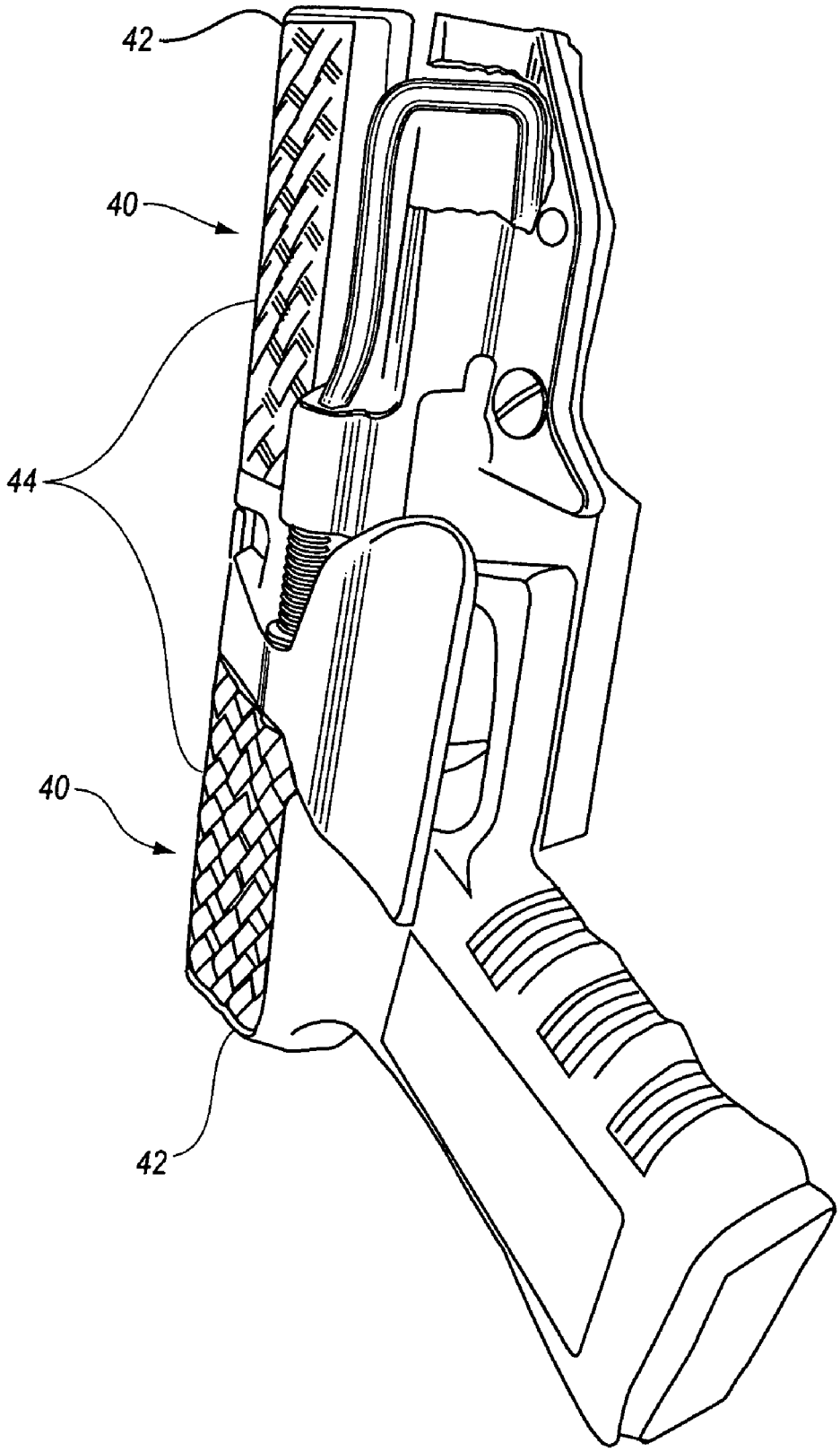
FIG. 9 is a perspective view of a right-handed security holster loaded with a handgun with the attachable overlay removed and a cutaway showing the U bar mechanism, the security holster is fitted with inlays.

FIG. 9 is a perspective view of a right-handed security holster fitted with inlays and an inserted handgun. Due to the inlay receiving regions 40, the inner wall 42 of the recess surrounds each edge of the inlay 44, and no inlay 44 edges are exposed to wear. The result of this is that the inlay receiving regions, used in conjunction with the inner wall 42, protects the inlays 44 from wear, and the inlays 44 do not tend to peel up at the edges. Into each of these recesses, an adhesive backed inlay 44 or other type of inlay 44 may be placed, glued, or fixed. These inlays 44 are the same depth as the recess or slightly less deep so that the inlay 44 does not extend above the surface of the holster. The purpose of the inlays 44 is to allow the holster to receive a decorative surface or insignia to match the requirements of any particular handgun user. For instance, one particular police department may require a certain style or finish on the accessories that the officers carry. In this way, a plastic holster can be covered with a decorative surface pattern, such as basket weave, to match the other accessories being carried by a police office. The inlays 44 may also contain the insignia of an organization or artwork preferred by any particular user. The inlays 44 may be of a color chosen by the user and may contain reflective material to make the holster more visible at night.

One embodiment of the holster is specifically for left-handed users of a semi-automatic handgun. FIG. 10 is a perspective view of a left-handed security holster. It includes a holster body. The holster body includes inner and outer rigid sidewalls that are spaced apart to define an inner cavity. The inner cavity has an open top portion into which the handgun 2 is inserted. The top portion is also identified as the rear of the holster. The portion of the holster that is adjacent to the end of the handgun barrel is designated as the front or bottom of the holster. The holster 10 also includes a locking mechanism, which is designed to allow the handgun to pass by it. When the handgun 2 is seated in the holster, the locking mechanism engages a feature of the handgun 2, thereby preventing the withdrawal of the handgun 2 prior to the release of the locking mechanism.

The security holster 10 also includes a releasing mechanism, which is mounted so that when a handgun 2 is inserted within the holster 10, the releasing mechanism is adjacent the right side of the handle of the handgun 2. In the left-handed version of the holster 10, the releasing mechanism is configured for activation by movement of a user's left thumb. The releasing mechanism is a release tab 16 that is depressed by a user's left thumb as he/she reaches for the handgun 2. When the user's hand is on the handle of the handgun 2, the release tab 16 is positioned directly below his/her thumb over the right side of the handgun handle. The release tab 16 is operationally connected to a locking tab 18, and when the release tab 16 is pressed down, the locking tab 18 disengages from the handgun feature and allows the handgun 2 to be withdrawn. As with the right-handed version previously described, the left handed security holster 10 shown if FIG. 10 operates in essentially the same fundamental way. The largest differences are that the release tab 16 is between the user and the rest of the holster as opposed to the right-handed version. The release tab 16 is also elongated to accommodate the user's thumb. Although available for use in left-handed holsters, the need for an attachable overlay is not as great. This is because the release mechanism is more naturally protected between the user and the rest of the holster from attack and some other similar circumstances.

This embodiment includes a releasing mechanism located adjacent to said left side handle of the handgun for releasing the locking mechanism by movement of a user's right thumb or left hand index finger. The releasing mechanism is a release tab 16 that it is configured for engagement with the user's right thumb when a user reaches for, releases, and removes the handgun 2 from the holster 10. The release tab 16 is operationally connected to a locking tab 18. The release tab 16 is activated by pressure of a user's right thumb or left hand index finger, which disengages the locking tab 18 from said handgun feature when said release tab is depressed.

This embodiment of the security holster includes a ramp that lifts the locking tab 18 out of the ejection port when the locking tab 18 moves forward. The release is connected to the locking tab 18 by a U bar 14 that passes from the left side of the handgun to the right side of the handgun. The rod has one or more springs attached to it, which urges the rod toward the rear of the holster and urges the locking tab into engagement with the ejection port.

Both the left and right-handed version of the holster provide for one-handed insertion of the handgun 2 into the security holster 10. When a handgun 2 is pressed into the holster 10, the locking tab 18 engages a handgun feature such as a trigger guard, the slide, or preferably an ejection port. This engagement prevents the handgun 2 from being withdrawn until the release tab 16 is engaged by the user's left thumb.

The locking tab 18 is a generally planar projection that extends from an arm connected to the release tab 16. The locking tab 18 is configured to move from an open position that allows entry of the handgun 2 without the handgun 2 touching the locking tab 18 into a closed position in which the locking tab 18 engages a feature of the handgun 2. The locking tab 2 can be activated to move into engagement with the handgun feature, such as the ejection port by compression of one or more springs built into the holster 10. Preferably, the locking tab 18 passes through the ejection port on the slide of the semi-automatic handgun and locks under the ejection port on the slide, adjacent the barrel of the handgun. Alternatively, any feature of the slide could also be utilized because not all models of handguns have a space under the ejection port that can be utilized. Once engaged, the locking tab 18 is typically pressed into engagement with the handgun feature by a spring, which is compressed during insertion into the holster 10.

The release tab 16 of the holster is typically an elongated tray, which is configured for sliding engagement with the user's left thumb. The elongated tray extends from over the trigger guard to partially over the handle of the handgun, which allows the left-handed user to activate the release tab 16 with his/her left thumb.

Another feature of this configuration of the device is that the locking tab 18 engages the handgun feature with an audible indication of locking. This is typically a distinctive click, which in most environments can easily be heard and is a certain indication to the user that the handgun is engaged in the holster. The locking tab engages with sufficient force so that there is also a tactile indication of locking, which the user may feel through the handle of the handgun or through the body of the holster into his/her hip region. This version of the holster typically includes a rotationally biased locking tab 18 that is biased toward the handgun 2, which activates the locking mechanism when the handgun is pressed into the holster with a required minimum compression force. The minimum compression force also operates with the releasing mechanism, and a minimum degree of compression force is required before the handgun is released.

A distinctive feature of the holster 10 is that one action is utilized to seat the handgun 2 and secure it in the holster 10. This action is pressing the handgun 2 down. Seating it in the locking mechanism of the holster 10 is clearly indicated by an audible click of the locking tab 18, and can also be felt through the user's hand or holster 10. Three actions are required to remove the handgun 2 from the holster 10. These three actions are: (1) pushing the handgun 2 down, (2) depressing the release tab 16 so that the locking tab 18 is disengaged from the ejection port, and (3) lifting the handgun out of the holster while depressing the release tab 16 for a certain portion of the withdrawal.

Figure 11:
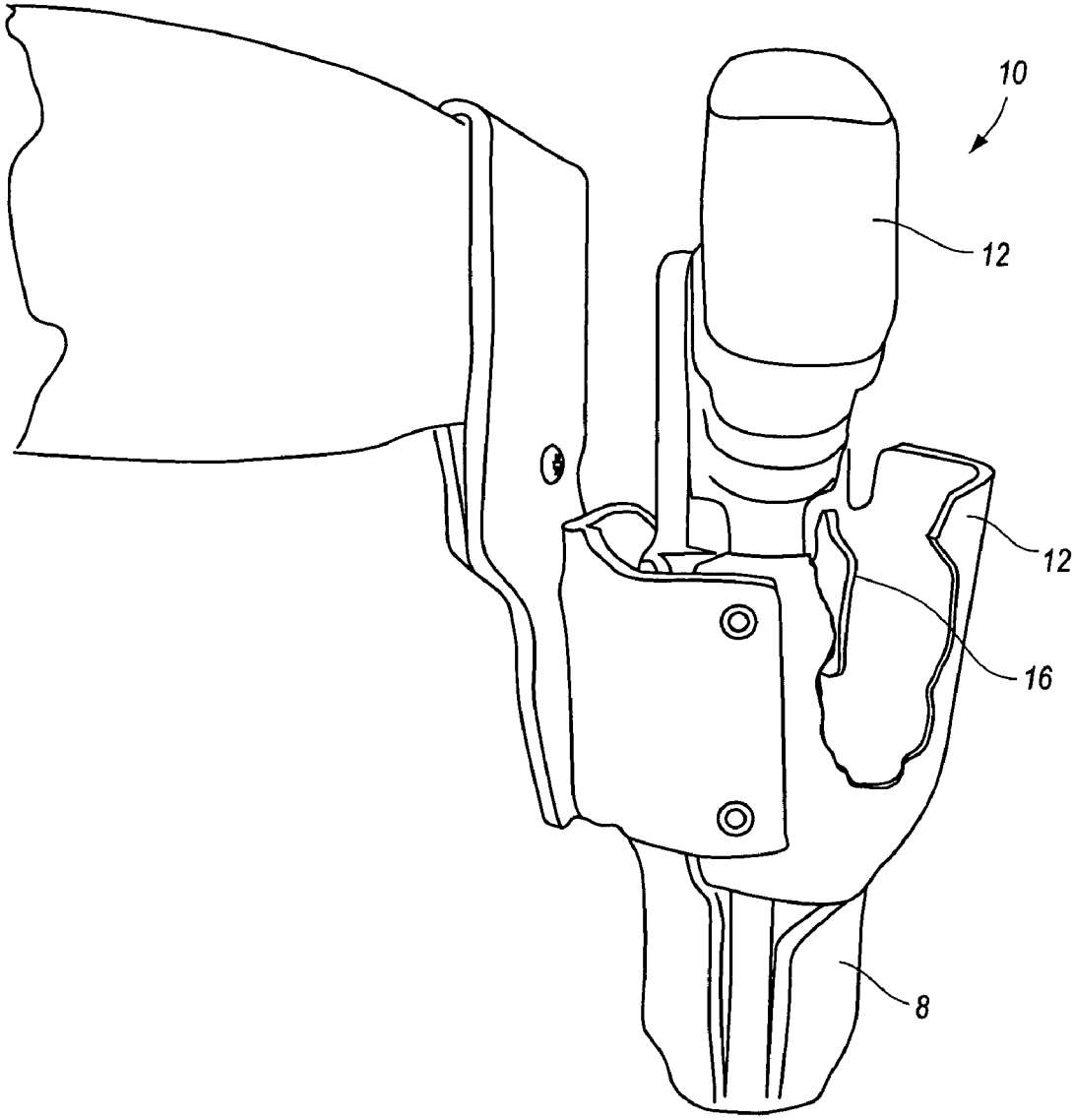
FIG. 11 is a partially cut away perspective view of the right-handed version of the holster of the invention.

FIG. 11 shows a partially cut away rear view of the holster of the invention. A portion of the holster that is partially cut away is the attachable overlay 12, which forms a protective finger tube around the release tab 16.

Figure 12:
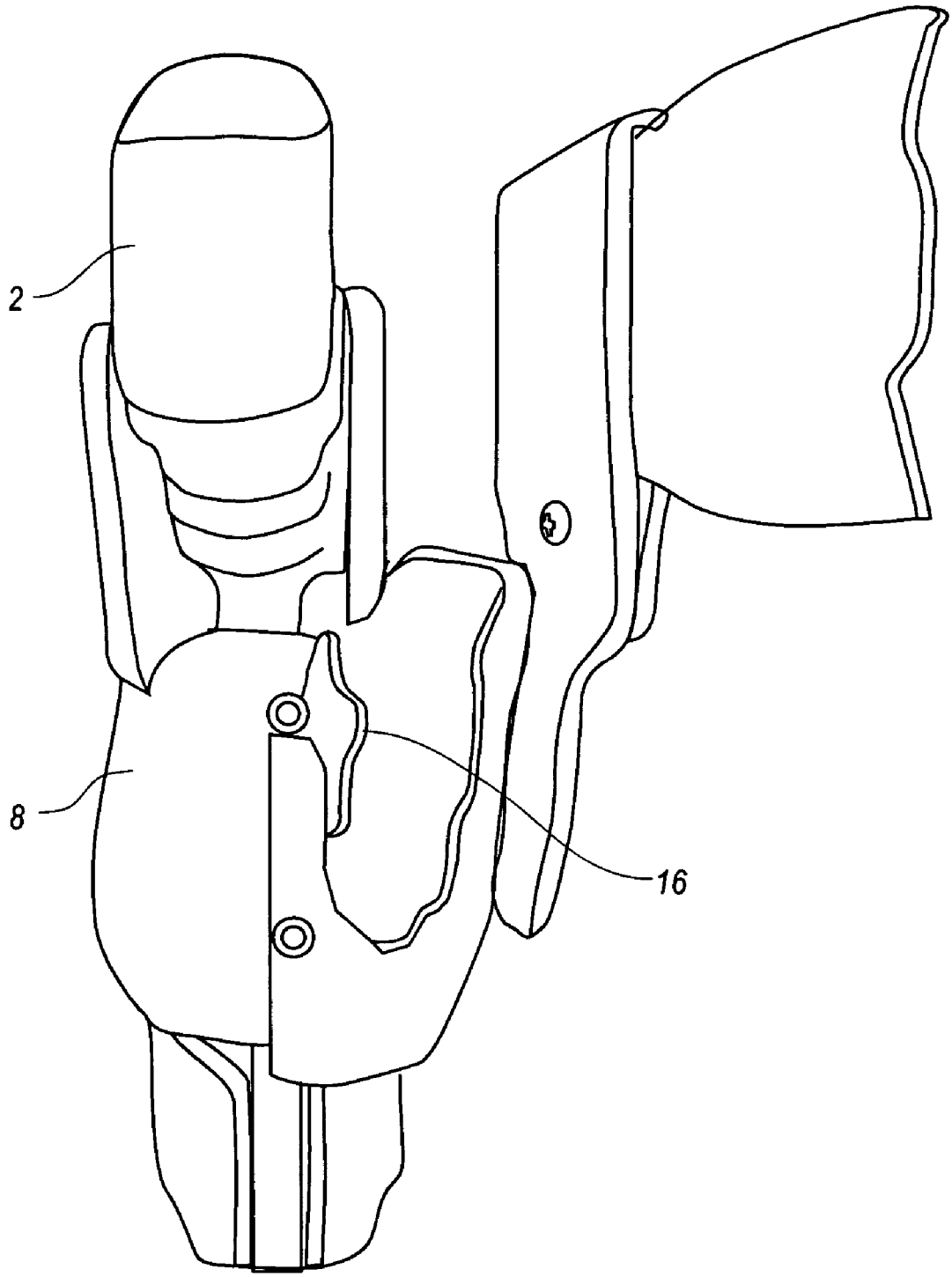
FIG. 12 is a partially cut away perspective view of the left-handed version of the holster of the invention.

FIG. 12 is a partially cut away rear perspective view of a left-handed version of the invention. In this version of the invention, as in FIG. 11, the release tab 16 is on the right side of the holster body 8. The release tab in this position is worn on the left side of a user's body, which allows a left-handed user to utilize his/her thumb to activate the release tab 16. In other respects, this version of the holster is consistent with versions previously described.

Figure 13A:
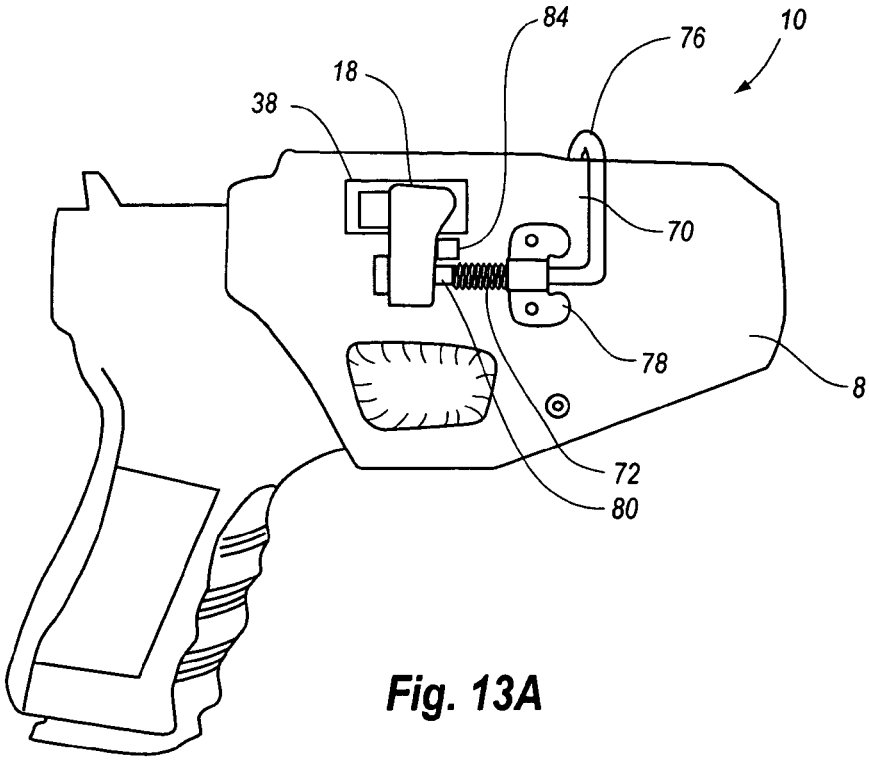
FIG. 13A is a view of the right side of one embodiment of the invention.

FIG. 13A is a view of the right side of another embodiment of the holster. On the right side of the holster is located a release ramp 84. This version utilizes a modified U-shaped rod 70, which has a right leg 72, a left leg 74 (shown in FIG. 13B), and a bridge section 76. Both the left leg 74 and the right leg 72 are attached to the holster body 8 by guides 78. In this version, the left leg 74 and right leg 72 each have a compression spring 80. The spring 80 operates as both a compression spring and a torsion spring. One end of it is attached to a locking tab 18, and causes it to be biased towards the holster body 8. Thus, the locking tab 18 is continually urged toward the ejection port slot 38.

Figure 13B:
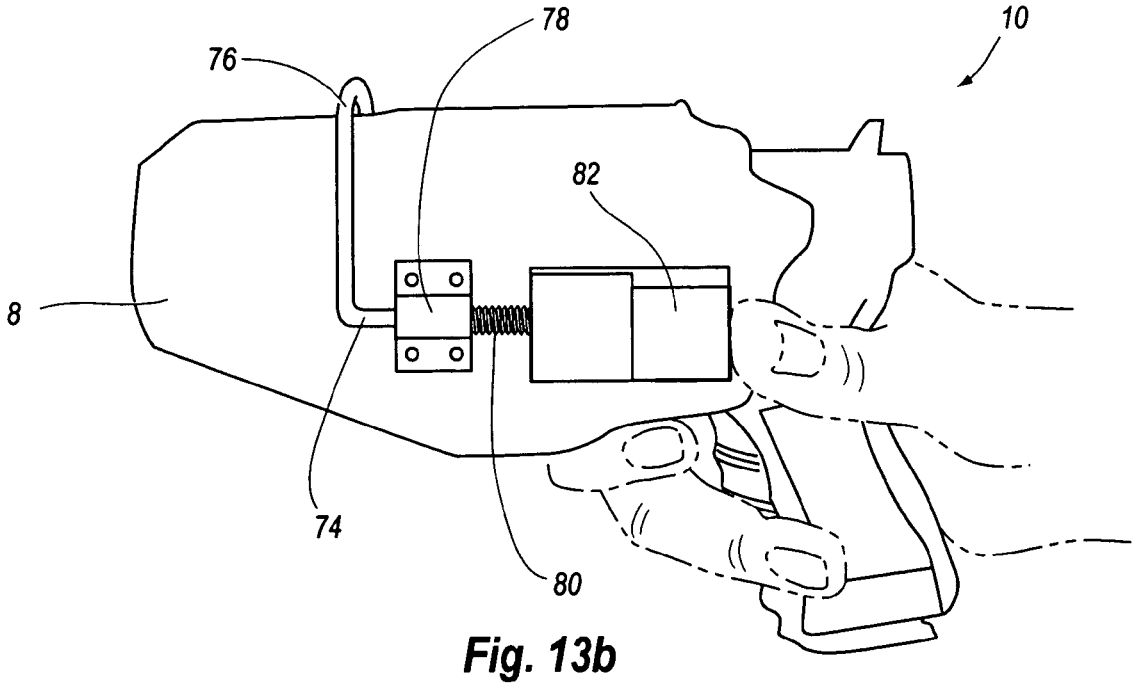
FIG. 13B is a view of the left side of one embodiment of the invention.

FIG. 13B shows that attached to the left leg 74 is a thumb bar 82. This is an angled surface, which is attached to the holster body 8. In this version of the security holster, several components are rigidly attached to each other and move as one unit. When the user presses on the thumb bar 82, the entire modified U-shaped rod 70 moves towards the barrel end of the holster. When this happens, the locking tab 18 (shown in FIG. 13A) also moves in that direction as the locking tab 18 encounters the release ramp 84 (shown in FIG. 13A), it rides up over the release ramp 84 (shown in FIG. 13A) and is lifted away from the handgun and out of the ejection port slot 38 (shown in FIG. 13A) of the security holster 10. The locking tab 18 is attached to the right leg 72 of the modified U-shaped rod 70, but it is able to rotate around that rod, which allows it to lift up away from the handgun, and also to drop down in place in the ejection port of the handgun.

From the foregoing description, it will be apparent that various changes may be made without departing from the spirit and scope of the invention as defined by the following claims. While there is shown and described the present preferred embodiment of the invention, it is to be distinctly understood that this invention is not limited thereto but may be variously embodied to practice within the scope of the following claims.

We claim:

1. A security holster for use with a semi-automatic handgun, wherein the holster comprises:

a holster body that includes a substantially rigid holster inner and outer sidewalls formed to define an inner cavity and an open top portion and a bottom portion, said inner and outer sidewalls together with said top and bottom portions configured to define a handgun shaped interior space, said holster body having a long axis, with said long axis extending from said open top portion of said holster to said bottom portion of said holster;

a generally U-shaped rod slidably mounted to said holster body, said U-shaped rod comprising an inner segment slidably attached to said inner sidewall and an outer segment slidably attached to said outer sidewall with one or more springs associated with said U-shaped rod which urge said U-shaped rod toward said open top portion of said holster body, wherein a bottom segment joins said inner and outer segments of said U-shaped rod and extends across said bottom portion of said holster body;

a locking tab attached to said outer sidewall of said holster body at a point approximately midway between said open end and said bottom portion of said holster body configured to move from a release position to a locking position, said release position being lateral from said long axis of said holster relative to said locking position of said locking tab and said locking position of said locking tab being medial to said long axis of said holster relative to said release position of said locking tab;

a release tab, attached to the holster body approximately midway between said top portion and said bottom portion of said holster, for moving said locking tab to said release position, with said release tab operationally connected to said locking tab, which when activated is configured to cause movement of said locking tab from said locking position to said release position.

2. The security holster of claim 1 in which said locking tab and said release tab are joined together on a lever, and are at opposite ends of said lever, and said lever has a fulcrum attached to one side of said U-shaped rod.

3. The security holster of claim 1, which further includes a pair of notches defined in the end of said holster body located near said bottom portion of said holster body, in which said U-shaped rod is positioned, and configured to move forward and backward in said notches.

4. The security holster of claim 1 which further includes a plurality of tube guides attached to said holster body, which enclose and guide said U-shaped rod.

5. The security holster of claim 1 which includes a finger tube formed by a region between said handgun shaped space and said holster body, said finger tube with an axis generally parallel to said long axis of said holster body, enclosing said release tab, which restricts access to said release tab, in which a user inserts a finger in order to activate said release tab to release said locking tab.

6. The security holster of claim 1, in which a portion of said U-shaped rod forms a resilient bumper for contact with the barrel of said handgun, for use in pressing said handgun into said holster against resistance creating said downward force against said U bar.

7. The security holster of claim 1 further comprising an attachable overlay that may be fixed to said holster body to form a finger receiving receptacle shielding said release tab from access.

8. The security holster of claim 1, wherein said locking tab is configured for engaging the ejection port of a semiautomatic handgun.

9. The security holster of claim 1, wherein said release tab is positioned over said trigger guard, and has an extended planar surface for allowing the release tab to be engaged by a left thumb of a left-handed user.

10. The security holster of claim 1, wherein said locking tab further comprises a ramped end for more easily locking and releasing said handgun in said security holster.

11. The security holster of claim 1 in which said U-shaped bar includes a left and a right compression spring, mounted to a left side and right side of said U-shaped bar, for urging said U-shaped bar toward the open end of the holster.

12. The security holster of claim 11 in which the right compression spring also serves as a torsion spring, and is connected to said lever, and presses said locking tab toward said handgun shaped space.

13. The security holster of claim 1, further comprising a plurality of grooves on said U-shaped rod for attaching a plurality of snap rings and bushings to fix in place said compression spring and said torsion spring for biasing said U bar and said lever.

14. The security holster of claim 13, further comprising at least one bushing near ends of said U-shaped rod wherein said at least one of said plurality of snap rings prevents said bushing from sliding off an end of said U-shaped rod wherein the biasing device is positioned on either side of said biasing device between said bushing and said left aperture on an inner side of said holster and said right aperture on an outer side of said security holster for requiring said minimum compression force and preventing said biasing device from making noise.

15. A security holster comprising:

a holster body with inner and outer spaced substantially rigid sidewalls defining an inner cavity and an open top portion for receiving a handgun therein and for removing a handgun there from, with the end of the holster that houses the barrel of the handgun being the front of the holster, and the end of the holster that houses the handle of the handgun being the rear of the holster wherein said outer spaced substantially rigid sidewall further defines a pair of notches at the front of said holster and a left guide and a right guide aperture running parallel to a long axis of said security holster;

a U-shaped rod mounted within said pair of notches at the front of said holster wherein ends of said U-shaped rod pass through said left and right guides wherein said U-shaped rod is biased by at least one biasing device to require a minimum compression force into said security holster in order to lock into place said handgun or activate a release tab for releasing said handgun, wherein said U-shaped rod presses against said handgun as said handgun is inserted into said holster body; and a first class lever wherein said first class lever further defines a pivot point through which said ends of said U-shaped rod pass through wherein a first end of said first class lever is said release tab and a fulcrum of said first class lever pivots about said pivot point and a second end of said first class lever is a locking tab torsionally biased by a interconnected torsion spring normal to said handgun for engaging a feature of said handgun.

16. The security holster of claim 15, wherein said biasing device is any of a compression or torsion spring.

17. A security holster for use with a semi-automatic handgun, the handgun having a trigger guard and trigger, an ejection port, a slide, and a handle, wherein the holster comprises:

a holster body that includes a substantially rigid holster sidewall formed to define an inner cavity shaped to receive a handgun therein, said holster body having a long axis parallel with said barrel portion of said handgun shaped space, said holster body includes a top portion corresponding to the handle portion of said handgun shaped space;

a U-shaped rod comprising a left segment approximately parallel with said long axis of said holster body and an right segment approximately parallel with said long axis of said holster body, wherein a bottom segment joins said left and right segments of said U-shaped rod and extends across said front of said holster body, generally U-shaped rod slidably mounted to said holster body, with one or more springs associated with said U-shaped rod which urge said U-shaped rod toward said open top portion of the holster body;

a locking tab configured to move from a release position to a locking position, and in said locking position to extend into said handgun shaped space;

a release tab, for moving said locking tab to said release position with said release tab operationally connected to said locking tab, which when activated moves said locking tab from said handgun shaped space; and an attachable overlay that may be fixed to said holster body to form a finger receiving receptacle shielding said release tab from access.

18. A security holster for a handgun comprising:

a releasing mechanism comprising a release tab, a locking tab biased normal to said handgun by a torsion spring and said locking tab rotationally connected to said release tab;

a U-shaped rod biased by at least one spring toward a receiving end of said security holster wherein said U-shaped rod passes through said releasing mechanism as a fulcrum about which said release tab and said locking tab rotate, wherein said U-shaped rod presses against said handgun as said handgun is inserted into said holster body;

an attachable overlay attachable to said security holster for defining a finger tube between said attachable overlay and a holster body and for protectively covering said release mechanism and said U-shaped rod from unwanted release of said handgun.

19. The security holster of claim 18, wherein said attachable overlay is a molded plastic part that is configured to snap into engagement with said holster body.

20. The security holster of claim 18, wherein said attachable overlay further comprises any of snaps, straps, screws, or bolts for attaching it to said security holster.

21. A security holster for use with a handgun, the handgun having a trigger guard, and trigger, comprising:

a holster body with inner and outer spaced substantially rigid sidewalls defining an inner cavity and an open top portion for receiving a handgun therein and for removing a handgun there from, with the end of the holster that houses the barrel of the handgun being the front of the holster, and the end of the holster that houses the handle of the handgun being the read of the holster;

a locking tab configured to admit said handgun into said security holster, and adapted to engage a handgun feature of said handgun placed in said inner cavity of said security holster, said locking tab thereby preventing the withdrawal of said handgun prior to release of said locking tab, said locking tab including a generally U-shaped rod with a right side, a left side, and a joining piece, with said right side positioned parallel to the right side of the holster, the left side position parallel to the left side of the holster, and the joining piece penetrating the holster through a pair of slots defined at the front end of the holster, with one or more springs which urge the U-shaped rod toward the rear of the holster, and with said locking tab attached to the U-shaped rod, wherein said U-shaped rod presses against said handgun as said handgun is inserted into said holster body;

a release tab rotatably mounted to said U-shaped rod, and located adjacent to said trigger of said handgun, for releasing said locking tab by flexure of a user's finger or thumb, said release tab comprising an elongated release tab which is biased by a torsional spring to engage said handgun feature when said one or more springs which urge the U-shaped rod are compressed toward the front of said holster wherein said elongated release tab which is configured for sliding engagement with an index finger or thumb of a user as a user reaches for, releases, and removes said handgun from said holster, with said elongate release tab operationally connected to said locking tab, and with said elongate release tab activated by flexure of a finger or thumb of said user, which disengages said locking tab from said handgun feature when said release tab is depressed; wherein said security holster provides for one handed insertion of said handgun into said security holster, via said locking tab which admits said handgun during insertion, and which engages a handgun feature for retention of said handgun unless said locking tab is disengaged by depression of said elongate release tab by flexure of said index finger or thumb, thereby providing said security holster with one finger release of said handgun, and one handed insertion and withdrawal of said handgun by sliding engagement of said elongate release tab with a user's index finger or thumb.

22. The security holster of claim 21, in which said U-shaped rod is configured to be moved toward the front of the holster by pressure from the handgun being pressed into the holster, and with the locking tab configured to move with the U-shaped rod and move from a position adjacent an ejection port of the holster, to a position over the ejection port of the holster and the handgun, and to drop into place in the ejection port of the handgun.

23. The security holster of claim 22, in which said locking tab is sized so that when seated in the ejection port, a force to remove said handgun from said holster without releasing said locking tab causes said locking tab to jam against the front side of the ejection port of the slide.

24. A security holster for use with a semi-automatic handgun, the handgun having a trigger guard and trigger, an ejection port, a slide, and a handle, wherein the holster comprises:

a holster body that includes a substantially rigid holster sidewall formed to define an inner cavity and an open top portion for receiving a handgun therein, and for removing a handgun therefrom, said holster body having a long axis parallel with said barrel of said handgun when secured in said holster body;

a generally U-shaped rod slidably mounted to said holster body, with one or more springs associated with said U-shaped rod which urge said U-shaped rod toward said open top portion of the holster body, wherein said U shaped rod presses against said handgun as said handgun is inserted into said holster body;

a locking tab configured to admit said semi-automatic handgun into said security holster body, and upon insertion of said handgun, to move from a release position to a locking position, and in said locking position to engage said ejection port of said semi-automatic handgun, thereby preventing the withdrawal of said handgun prior to release of said locking tab;

a release tab, for moving said locking tab to said release position for withdrawal of said handgun, with said release tab operationally connected to said locking tab, which when activated disengages said locking tab from handgun feature and further which said locking tab and said release tab are joined together on a lever, and are at opposite ends of said lever, and said lever has a fulcrum attached to one side of said U-shaped rod.

* * * * *

UNITED STATES PATENT AND TRADEMARK OFFICE

CERTIFICATE OF CORRECTION

PATENT NO. : 7,584,875 B2
APPLICATION NO. : 10/877780
DATED : September 8, 2009
INVENTOR(S) : Lowe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1138 days.

Signed and Sealed this

Fourteenth Day of September, 2010

David J. Kappos

David J. Kappos
*Director of the United States Patent and Trademark Office*